US005434386A

United States Patent [19]

Glenn et al.

[11] Patent Number: 5,434,386

[45] Date of Patent: Jul. 18, 1995

[54] ELECTRIC CIRCUIT HAVING A HEATER ELEMENT AND A NIGHT LIGHT

[75] Inventors: Neville R. Glenn, Milford; Jordan Kahn, Wellesley, both of Mass.

[73] Assignee: Holmes Products Corp., Milford, Mass.

[21] Appl. No.: 115,415

[22] Filed: Sep. 1, 1993

[51] Int. Cl.[6] ..... H05B 1/02

[52] U.S. Cl. ..... 219/483; 219/506; 219/487; 219/502; 219/220

[58] Field of Search ..... 219/214, 220, 483, 486, 219/502, 506, 487, 521

[56] References Cited

U.S. PATENT DOCUMENTS

| | | | |
|---|---|---|---|
| 2,341,648 | 9/1941 | Parr . | |
| 2,681,978 | 7/1950 | Franklin . | |
| 3,005,904 | 7/1960 | Thompson . | |
| 3,780,260 | 12/1973 | Elsner . | |
| 3,881,091 | 4/1975 | Day | 219/486 |
| 4,216,176 | 8/1980 | Tanaka . | |
| 4,700,048 | 10/1987 | Levy | 219/214 |
| 4,755,653 | 7/1988 | Townsend et al. . | |
| 4,873,422 | 10/1989 | Streich et al. . | |
| 4,874,929 | 10/1989 | Houser | 219/506 |
| 4,890,205 | 12/1989 | Shaffer . | |
| 5,210,396 | 5/1993 | Sanders | 219/521 |
| 5,231,266 | 7/1993 | Warren | 219/521 |

*Primary Examiner*—Mark H. Paschall
*Attorney, Agent, or Firm*—Kriegsman & Kriegsman

[57] ABSTRACT

An electric circuit is disclosed which includes a heater element for generating heat, a power switch for controlling the current to the heater element, a night light for providing illumination, and a night light switch for controlling the current through the night light. The night light is operable separately and independently of the heater element. In one embodiment for use in a humidifier the electric circuit further includes a thermo fuse, a thermo disc and a refill light. In another embodiment for use in a heater the circuit further includes a fan, a power light and a second heater element for generating heat.

8 Claims, 4 Drawing Sheets

ELECTRIC CIRCUIT HAVING A HEATER ELEMENT AND A NIGHT LIGHT

BACKGROUND OF THE INVENTION

The present invention relates generally to an electric circuit and more particularly to an electric circuit having a heater element and a night light. In one embodiment of the invention the electric circuit is constructed for use in a heater and in another embodiment of the invention the electric circuit is constructed for use in a humidifier.

In U.S. Pat. No. 4,873,422 there is disclosed a heater assembly supported by an electrical receptacle mounted in a wall. A cover supports an enclosed heater and a fan forces air into the cover to be discharged into a space. A mount directly supports the cover when mated with the receptacle. To maintain the assembly in position, a contact or leg is situated below the mount and receptacle. The heater assembly includes a panel which, as mentioned in the patent, may contain a night light.

In U.S. Pat. No. 4,755,653 there is disclosed a radiant heater assembly that includes a heating element for generating heat radiantly to warm a space to be heated. The heater assembly includes a sensor for sensing temperature within the radiant heater assembly. An overheat control unit is provided for automatically disabling the heater elements upon exposure of the sensor to temperature in excess of a predetermined threshold temperature. Alert indicators are provided for indicating disablement of the heater elements upon actuation of the overheat control unit. A tip-over switch is provided for activating the alert indicators independent of actuation of the overheat control unit in response to predetermined tilting movement of the radiant heater assembly relative to normal upright position.

In U.S. Pat. No. 4,216,176 there is disclosed a humidifier comprising an electric lamp, a protector in the form of a dome-shaped member surrounding the glass bulb of the electric lamp, an evaporation layer made of capillary substance closely contacted with the outer surface of the protector to cover the same, and a water-holding saucer for immersing a portion of the evaporation layer in water or a tightly closed tank having a water supply port at the lower end thereof which communicates with the outer surface of the evaporation layer in sealed relation to the outside. By making the protector of light transmitting material, the humidifier can be used also as an all-night light. The evaporation layer is surrounded with an ornamental cover having water vapor outlets.

In U.S. Pat. No. 3,780,260 there is disclosed a combination night light and vaporizer for liquids in which a plug-in electric wall bracket removably receives a throw-away container in the form of a dispensing package containing the vaporizable liquid. An electric lamp in the bracket provides a heat source for vaporizing the liquid in the container as well as the illumination for the night light, the lamp being controlled through an energizing circuit which includes an electric flow path in the vaporizable liquid between spaced electrodes built into the container, and an overriding manually operable switch enables the establishing of a circuit between the electrodes when there is no liquid in the container and it is desired to energize the lamp for use as a night light.

Other known references of interest include U.S. Pat. No. 4,890,205, U.S. Pat. No. 3,005,904, U.S. Pat. No. 2,681,978 and U.S. Pat. No. 2,341,648.

SUMMARY OF THE INVENTION

It is an object of the present invention to provide a new and improved electric circuit.

It is another object of the present invention to provide an electric circuit having a heater element and a night light.

It is still another object of the present invention to provide an electric circuit as described above which includes a heater element and a night light, and wherein the heater element and night light are independently operable.

It is still another object of the present invention to provide an electric circuit as described above which can be mass produced, has a minimal number of parts and can be easily assembled.

In furtherance of the objects broadly set forth above, an electric circuit is provided which comprises a heater element, a power switch for energizing the heater element, a night light and a night light switch for energizing the night light, the night light being operable separately and independently of the heater element. In one embodiment for use in a humidifier, the circuit may further include a thermo fuse, a thermo disc and a refill light. In another embodiment for use in a heater, the circuit may further include a fan, a power light, an overtemperature thermostat and a second heater element.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 1:
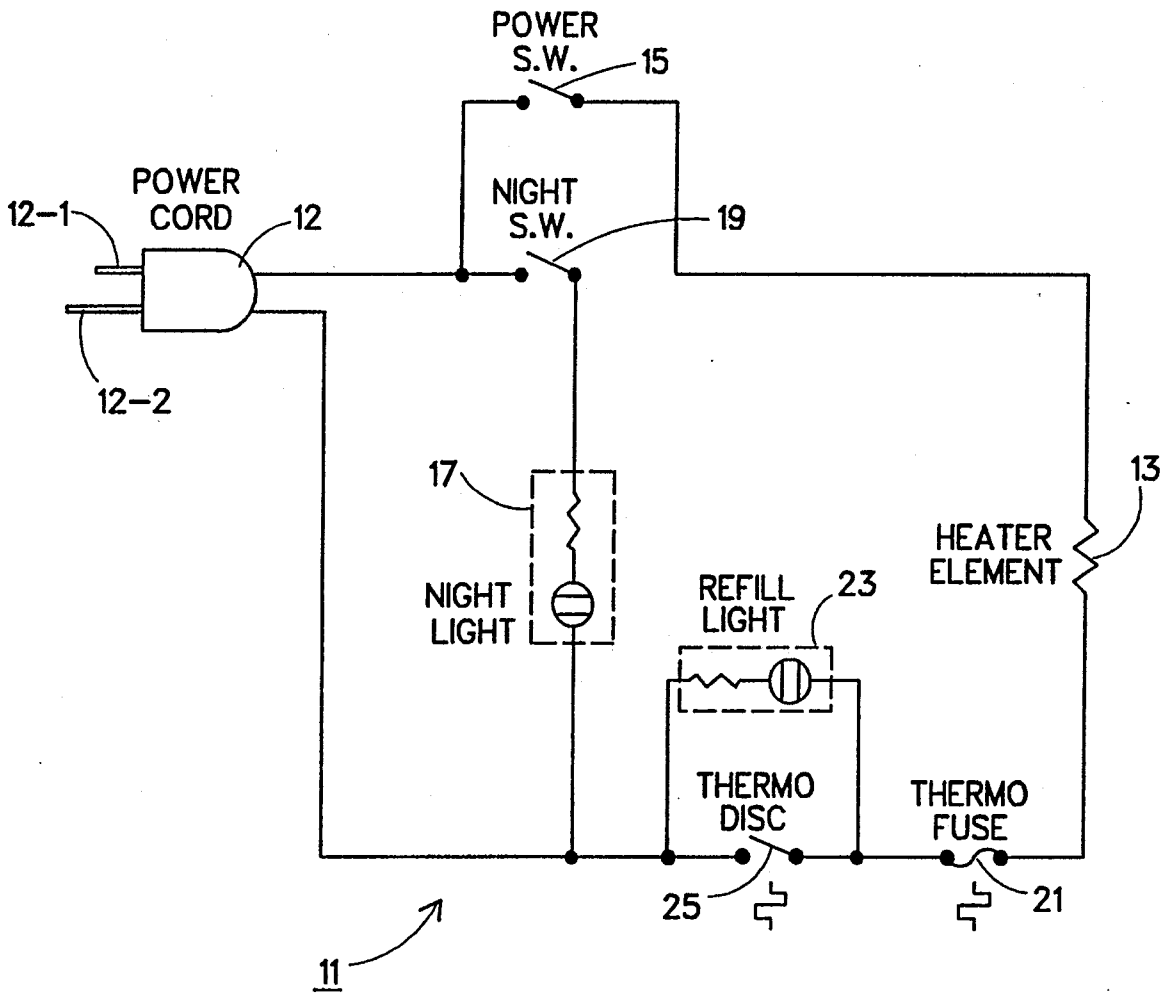
FIG. 1 is a schematic of one embodiment of an electric circuit constructed according to the teachings of the present invention.
Figure 2:
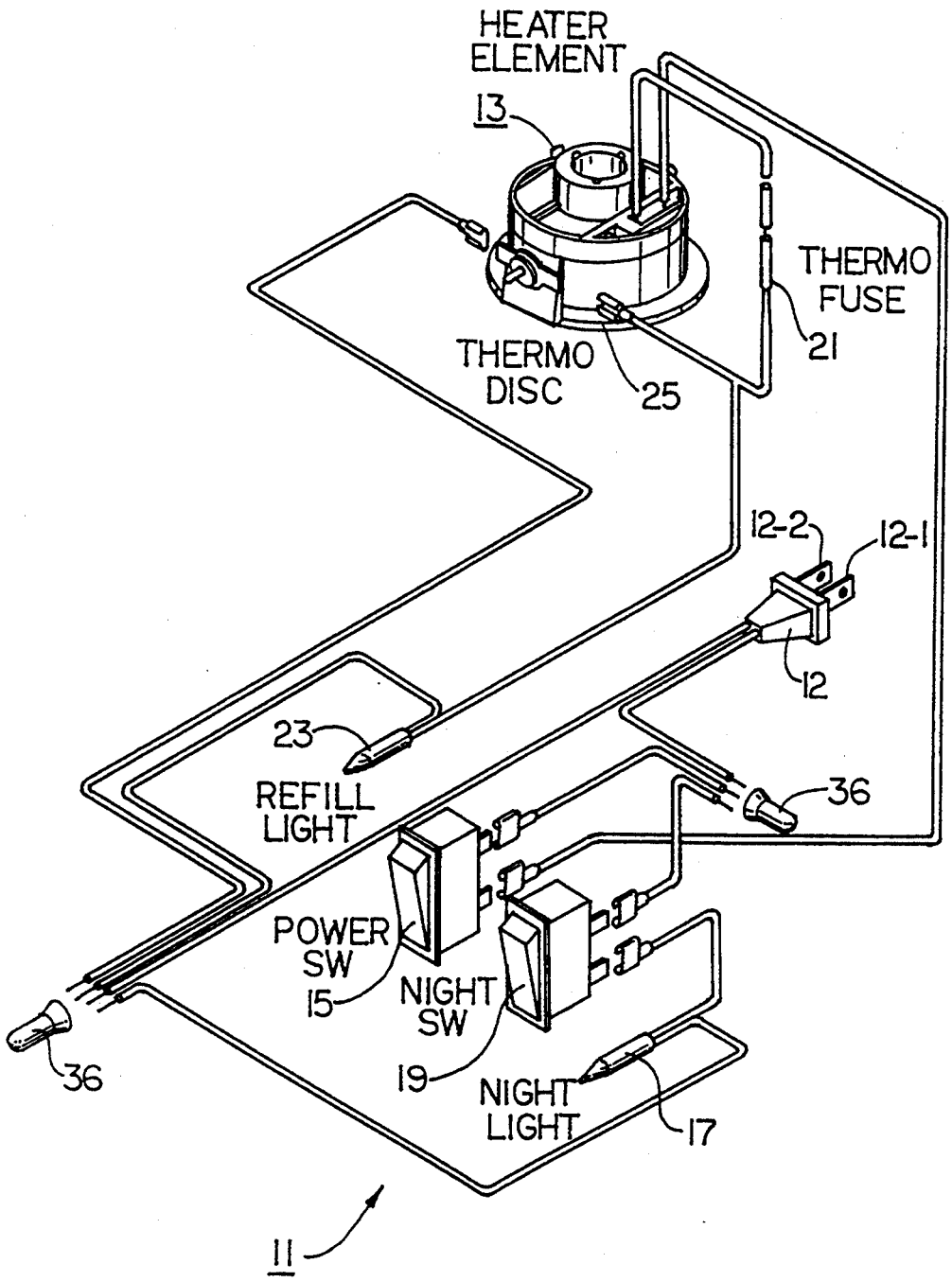
FIG. 2 is a hardware implementation of the electric circuit shown in FIG. 1.

Referring now to FIGS. 1 and 2, there is shown one embodiment of an electric circuit constructed according to this invention and being identified by reference numeral 11, electric circuit 11 being constructed for use in a humidifier of the type in which water is heated.

Electric circuit 11 includes an input plug 12 for connecting circuit 11 to an electrical outlet (not shown). Plug 12 has a pair of poles 12-1 and 12-2. Electric circuit 11 also includes a heater element 13 for generating heat. An on/off type power switch 15 is provided for controlling the current supplied to heater element 13. A night light 17 is included to provide illumination. An on/off type night light switch 19 is provided to control the current supplied to night light 17. As can be seen, night light 17 and switch 19 are arranged so that night light 17 operates independent of whether power is being supplied to heater element 13.

Electric circuit 11 further includes a thermo fuse 21, a refill light 23, and a thermo disc 25. Thermo fuse 21 is normally closed. Thermo fuse 21 is used as a safety backup if thermodisc 25 fails to permanently deactivate heating element 13 when the temperature inside the humidifier circuit 11 exceeds a predetermined temperature. Refill light 23 is used to indicate to the operator that the tank (not shown) in the humidifier requires more water. Thermo disc 25 is a normally closed thermostat which is preset at a specific temperature above which heating element 13 is deactivated (i.e. turned off). Also shown in the FIG. 2 implementation are solderless connectors 36.

When thermo disc 25 is closed, the current supplied to refill light 23 is not sufficient to cause light 23 to be illuminated. On the other hand, when thermo disc 25 is open, the current supplied to refill light 23 will cause refill light 23 to light up and the current supplied to heater element 13 will not be sufficient to cause heater element 13 to heat up.

Figure 3:
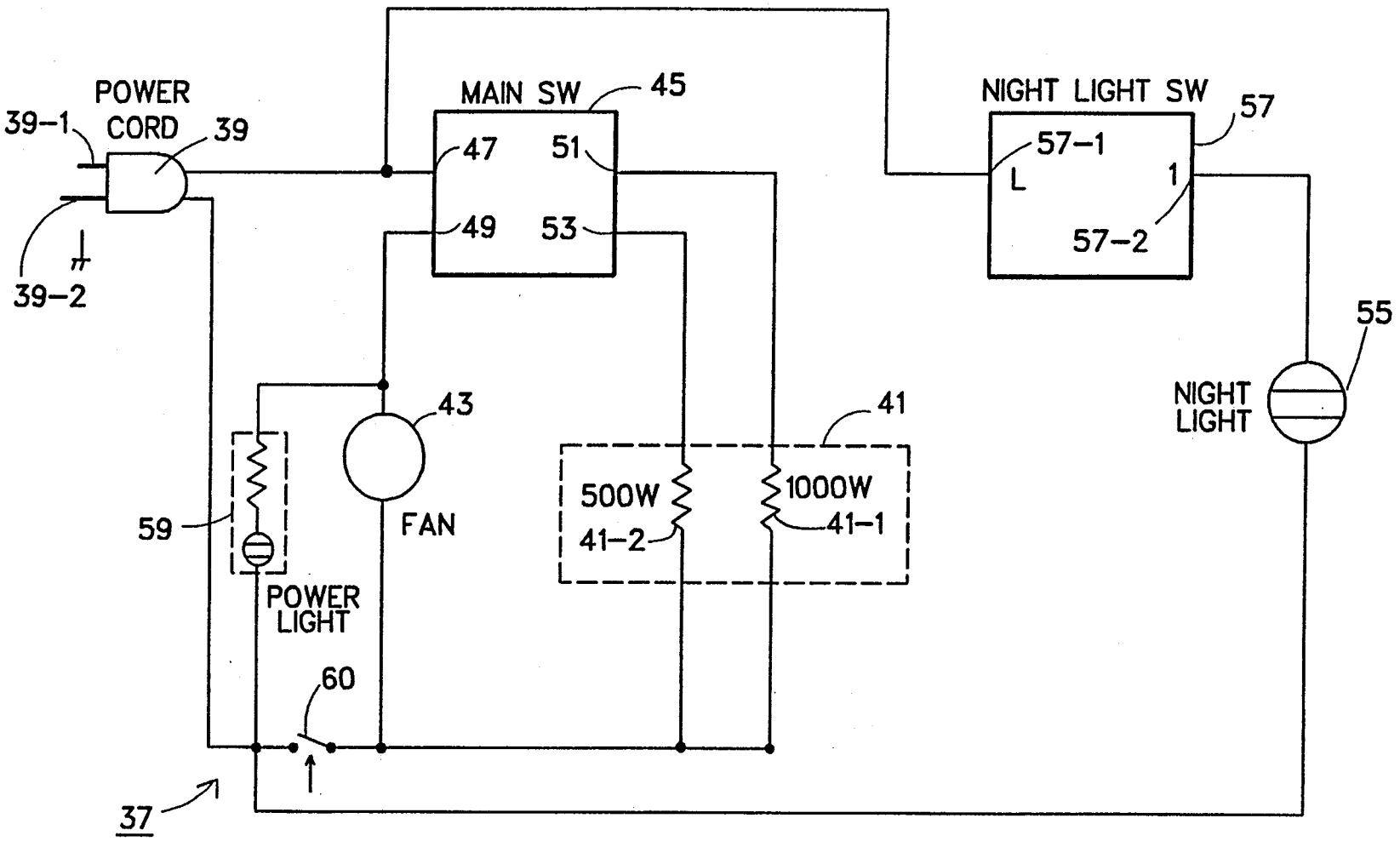
FIG. 3 is a schematic of another embodiment of an electric circuit constructed according to the teachings of the present invention.
Figure 4:
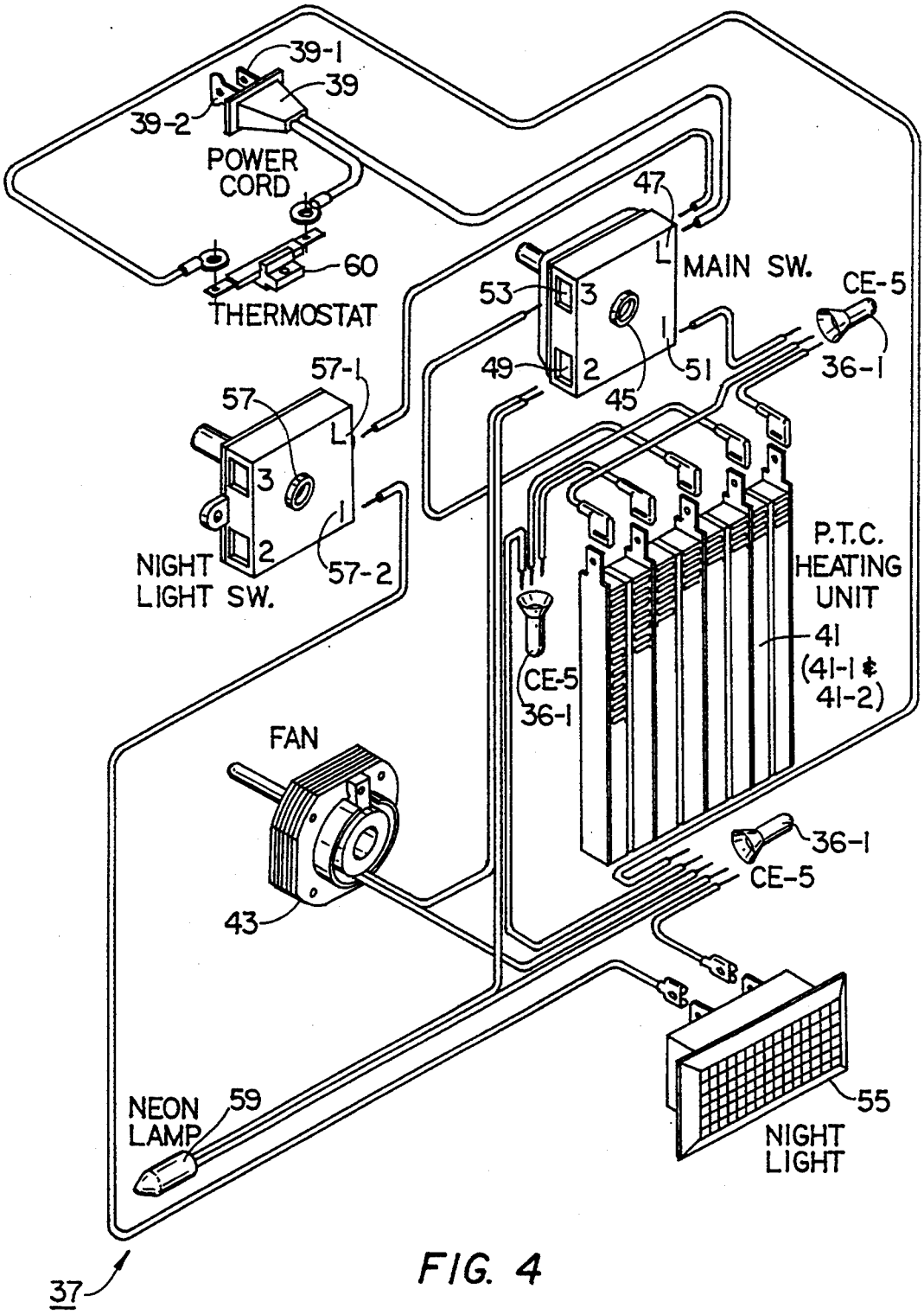
FIG. 4 is a hardware implementation of the electric circuit shown in FIG. 3.

Referring now to FIGS. 3 and 4, there is shown another embodiment of an electric circuit constructed according to this invention, the second embodiment representing an electric circuit designed for use in a heater and being identified by reference numeral 37.

Heater circuit 37 includes an input plug 39 which may be connected to an outlet (not shown). Plug 39 has a pair of poles 39-1 and 39-2.

Heater circuit 37 includes a heater section 41 having a first heater element 41-1 and a second heater element 41-2. In FIG. 4 elements 41-1 and 41-2 are shown as a P.T.C. (ceramic) heating unit. Heater circuit 37 also includes a motor operated electric fan 43 that circulates air around and through heater circuit 37 to increase its effectiveness.

Heater elements 41-1 and 41-2 and electric fan 43 are controlled by a selector switch 45. Selector switch 45 is a four position rotary type switch that includes four terminals labeled 47, 49, 51 and 53 and a shorting bar (not shown). Terminal 47 is connected to a first pole 39-1 of plug 39. When the rotary element (not shown) is in position 1, terminal 47 is not electrically connected to any of terminals 49, 51 and 53 and the electric heater is in an "off" mode (i.e. neither heater section 41 nor fan 43 are "on"). When the rotary element is in position 2, terminal 47 is connected to terminal 49. In this position, heater section 41 is in an "off" mode and electric fan 43 is in an "on" mode. When the rotary element is in position 3, terminal 47 is connected to terminals 49 and 45 in which case, electric fan 43 is in an "on" mode and the heater section 41 is in a low heat mode. When the rotary element is in position 4, terminal 47 is connected to terminals 49, 51, and 53 in which case, electric fan 43 is in an "on" mode and the heater section 41 is in a high heat mode.

Heater circuit 37 also includes a night light 55, to provide illumination. Night light 55 is controlled by a selector switch 57. Selector switch 57 is a four position rotary type switch that includes two terminals labeled 57-1 and 57-2 and a shorting bar (not shown). Terminal 57-1 is connected to a first pole 39-1 of plug 39. When the rotary element (not shown) is in position 1, terminal 57-1 is not electrically connected to terminal 57-2 and the night light 55 is in an "off" mode. When the rotary element is in position 2, terminal 57-1 is connected to terminal 57-2. In this position, night light 55 is in an "on" mode.

Heater circuit 37 also includes a power light 59 that is coupled between the second pole 39-2 of plug 39 and the motor 43 to indicate when heat selector switch 45 is in one of the three "on" positions.

In addition heater circuit 37 includes an overtemperature thermostat 60 which is normally closed but will open when the internal temperature exceeds a predetermined temperature. Also shown in the FIG. 4 implementation are solderless connectors 36-1.

As can be appreciated, in both embodiments the night light can be turned on or off regardless of the position of the power switch.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. An electric circuit for use in a humidifier or a heater comprising:

a) heater means for generating heat, b) a power switch for controlling the flow of current to the heater means, c) a night light for providing illumination, and d) a night light switch for controlling the flow of current to the night light, e) the night light being operable separately and independently of the heater means and being controlled solely by said night light switch, and f) the heater means being operable separately and independently of the night light and being controlled solely by said power switch.

2. The electric circuit as claimed in claim 1 wherein the night light is an electric lamp type night light.

3. The electric circuit as claimed in claim 2 wherein the night light switch is an on/off type night light switch.

4. The electric circuit as claimed in claim 1 wherein the electric circuit is for use in a humidifier and further includes a refill light for indicating the humidifier is low in water, a permanent fuse and a preset thermostat.

5. The electric circuit as claimed in claim 1 wherein said heater means comprises first and second heater elements and said circuit further includes a fan, a power light and an overtemperature thermostat.

6. The electric circuit of claim 5 and wherein the power switch means for energizing the first and second heater elements means is a rotary-type switch.

7. The electric circuit of claim 6 wherein the night light switch for energizing the night light is a rotary type switch, one position being open and the other position being closed.

8. The electric circuit of claim 1 and wherein said heater means includes a P.T.C. (ceramic) heating unit.

* * * * *